US010810933B1

(12) United States Patent
Lin et al.

(10) Patent No.: US 10,810,933 B1
(45) Date of Patent: Oct. 20, 2020

(54) CONTROL CIRCUIT FOR DRIVING PIXEL CIRCUIT

(71) Applicant: AU Optronics Corporation, Hsin-Chu (TW)

(72) Inventors: Chun-Feng Lin, Hsin-Chu (TW); Chuang-Cheng Yang, Hsin-Chu (TW); Ming-Hsien Lee, Hsin-Chu (TW); Yi-Cheng Lin, Hsin-Chu (TW); Wei-Chia Chiu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/505,784

(22) Filed: Jul. 9, 2019

(30) Foreign Application Priority Data

Mar. 25, 2019 (TW) ..... 108110342 A

(51) Int. Cl.
*G09G 3/30* (2006.01)
*G09G 3/32* (2016.01)

(52) U.S. Cl.
CPC ..... *G09G 3/32* (2013.01); *G09G 2310/061* (2013.01); *G09G 2330/028* (2013.01)

(58) Field of Classification Search
CPC .. G09G 3/36; G09G 3/30; G09G 5/00; G09G 3/32; G06F 3/038
See application file for complete search history.

(56) References Cited

U.S. PATENT DOCUMENTS

| | | | | |
|---|---|---|---|---|
| 2004/0036664 | A1 | 2/2004 | Miyazawa | |
| 2004/0196275 | A1 | 10/2004 | Hattori | |
| 2008/0062089 | A1* | 3/2008 | Kim | G09G 3/3275 345/76 |
| 2008/0218499 | A1* | 9/2008 | Kohno | G09G 3/3233 345/204 |
| 2016/0275866 | A1* | 9/2016 | Liu | G09G 3/3291 |
| 2017/0263186 | A1* | 9/2017 | Wang | G09G 3/3258 |
| 2018/0130409 | A1* | 5/2018 | Xiang | G09G 3/3233 |
| 2019/0340979 | A1* | 11/2019 | Yang | G09G 3/3258 |

FOREIGN PATENT DOCUMENTS

| | | | |
|---|---|---|---|
| CN | 1471069 | A | 1/2004 |
| CN | 101256738 | A | 9/2008 |
| CN | 106847188 | A | 6/2017 |
| TW | I225231 | | 12/2004 |
| TW | 201227679 | A1 | 7/2012 |

* cited by examiner

*Primary Examiner* — Pegeman Karimi
(74) *Attorney, Agent, or Firm* — WPAT, PC

(57) ABSTRACT

A control circuit includes a power supply switch unit and a reset switch unit. The power supply switch unit is electrically connected to a data line and a pixel circuit. When the data line has a data voltage, the power supply switch unit is turned on according to a power supply signal, so that the pixel circuit is charged by the data voltage. The reset switch unit is electrically connected to the pixel circuit. After the pixel circuit is charged by the data voltage, the reset switch unit is turned on according to the reset signal to reset a voltage of the pixel circuit to the reset voltage.

11 Claims, 7 Drawing Sheets

CONTROL CIRCUIT FOR DRIVING PIXEL CIRCUIT

CROSS-REFERENCE TO RELATED APPLICATION

This application claims priority to Taiwan Application Serial Number 108110342, filed Mar. 25, 2019, which is herein incorporated by reference in its entirety.

BACKGROUND

Technical Field

The present disclosure relates to a control circuit, especially a circuit structure that receiving a data voltage by a data line to drive a pixel circuit.

Description of Related Art

Flat panel display is one of the most popular display device because of the high-quality image display capability and low power consumption. Based on the manufacturing cost, the multiplexer and the corresponding control circuit are arranged in the display panel of the display device to control the number of transmission channels on the wafer and the overall size.

In general, the pixels in the display panel can be driven by different polarity voltages. The multiplexer alternately receives operating voltages of different polarities according to the corresponding driving manner, and sequentially charges each pixel to produce the desired brightness. Therefore, the multiplexer and the control circuit have the most direct effect on the display quality of the display panel.

SUMMARY

One aspect of the present disclosure is a control circuit. The control circuit includes a first driving circuit and a second driving circuit. The first driving circuit includes a first power supply switch unit and a first reset switch unit. The first driving circuit is electrically connected to a data line and a first pixel circuit, and is configured to turn on according to a first power supply signal. The first reset switch unit is electrically connected to the first pixel circuit, and is configured to turn on according to a first reset signal. The second driving circuit includes a second power supply switch unit and a second reset switch unit. The second driving circuit is electrically connected to the data line and a second pixel circuit, and is configured to turn on according to a second power supply signal. The second reset switch unit is electrically connected to the second pixel circuit, and is configured to turn on according to a second reset signal.

Another aspect of the present disclosure is a control circuit. The control circuit includes a power supply switch unit and a reset switch unit. The power supply switch unit is electrically connected to a data line and a pixel circuit. When the data line has a data voltage, the power supply switch unit is turned on according to a power supply signal so that the pixel circuit is charged by the data voltage. The reset switch unit is electrically connected to the pixel circuit. After the pixel circuit is charged by the data voltage, the reset switch unit is turned on according to a reset signal to reset a voltage of the pixel circuit to the reset voltage.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1B:
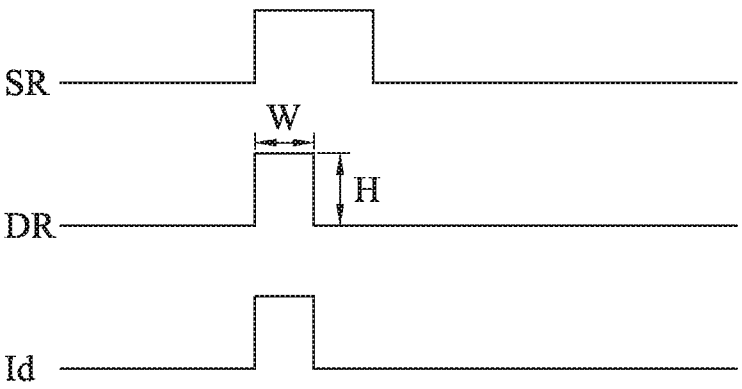
FIG. 1B is a waveform diagram of a pixel circuit in some embodiments of the present disclosure.
Figure 1A:
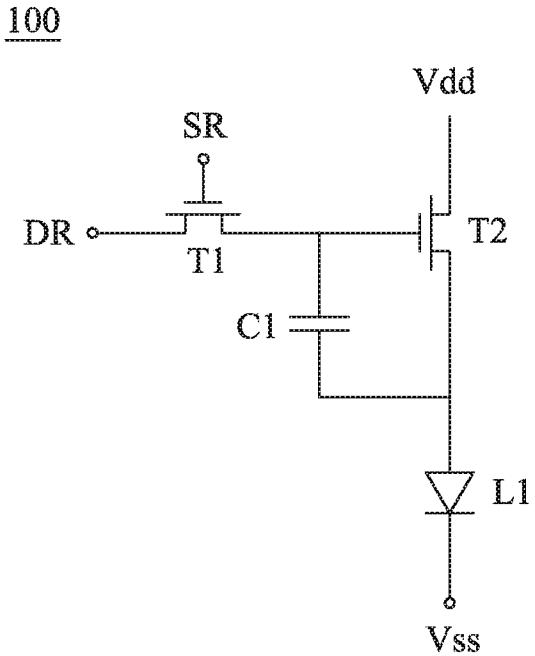
FIG. 1A is a schematic diagram of a pixel circuit in some embodiments of the present disclosure.

The present disclosure relates to a control circuit for transmitting a data voltage to a pixel circuit so as to charge the pixel circuit and produce a corresponding illumination. For convenience of understanding, here explaining the operation of the pixel circuit. Refer to FIGS. 1A and 1B. FIG. 1A is a diagram of a part of the pixel circuit in some embodiments of the present disclosure. FIG. 1B is a signal waveform diagram of the pixel circuit 100. The pixel circuit 100 includes transistors T1, T2, a capacitor C1, and a light-emitting element L1 (e.g., a light emitting diode). The transistor T1 is turned on according to a scan signal SR so that a data signal DR may be charged to the capacitor C1. Then, the transistor T2 is turned on through the power supply voltages Vdd, Vss, so that the driving current Id flows through the light-emitting element L1. As shown in FIG. 1B, the intensity H and duration W of the data signal DR will affect the brightness of the light produced by the light-emitting element L1. However, since the relationship between the data signal DR, the drive current Id, and the light intensity is not linear, it is not easy to control.

One of the purposes of the control circuit of the present disclosure is to improve the controllability of the luminance of the pixel circuit, but the pixel circuit of the present disclosure is not limited to the pixel circuit 100 shown in FIG. 1A. In addition, the control circuit of the present disclosure is not limited to application to a multiplexer.

Figure 2:
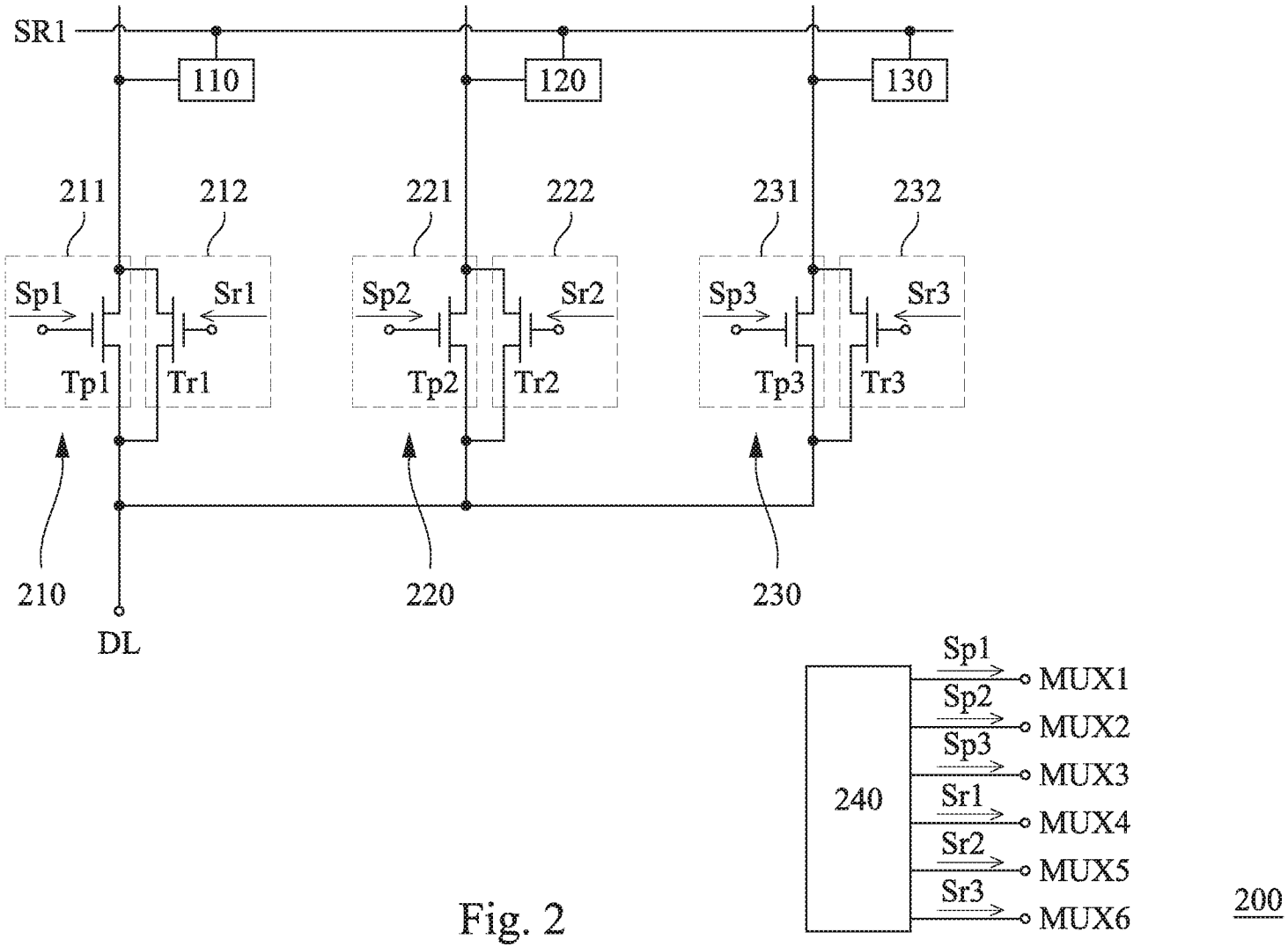
FIG. 2 is a schematic diagram of a pixel circuit in some embodiments of the present disclosure.

Referring to FIG. 2, FIG. 2 is a partial schematic diagram of the control circuit 200 in some embodiments of the present disclosure. In some embodiments, the control circuit 200 is applied to a display device to drive the pixel circuit 100 within the display device. The control circuit 200 includes the first driving circuit 210. The first driving circuit 210 includes the first power supply switch unit 211 and the first reset switch unit 212. The first power supply switch unit 211 is electrically connected to the data line DL and the first pixel circuit 110. When the data line DL has a first data voltage Vd1 (e.g., a voltage corresponding to the gray scale value "120"), and the scan line GL of the display device has a scan voltage SR1, the first power supply switch unit 211 is turned on adding to the first power supply signal Sp1, so that the first pixel circuit 110 is turned on by the scan voltage SR1 and charged according to the first data voltage Vd1.

The first reset switch unit 212 is electrically connected to the first pixel circuit 110. After the first pixel circuit 110 has been charged by the first data voltage Vd1, the first reset switch unit 212 is turned on according to the first reset signal Sr1 to reset the voltage of the first pixel circuit 110 to the reset voltage Vref (e.g., a corresponding voltage of the gray scale value 0). In some embodiments, the first power supply switch unit 211 is connected in parallel with the first reset switch unit 212 so that the first reset switch unit 212 is also electrically connected to the data line DL. That is, after the first pixel circuit 110 has been charged by the first data voltage Vd1, the voltage on the data line DL will change to the reset voltage Vref to reset the first pixel circuit 110 through the first reset switch unit 212. In other embodiments, a terminal of the first reset switch unit 212 is electrically connected to the first pixel circuit 110, and the other terminal is connectable to a reference line to receive the reset voltage Vref. That is, when the first pixel circuit 110 has been charged by the data voltage Vd1, the first power supply switch unit 211 will be turned off, and the first pixel circuit 110 will be reset by the first reset switch unit 212.

Figure 3:
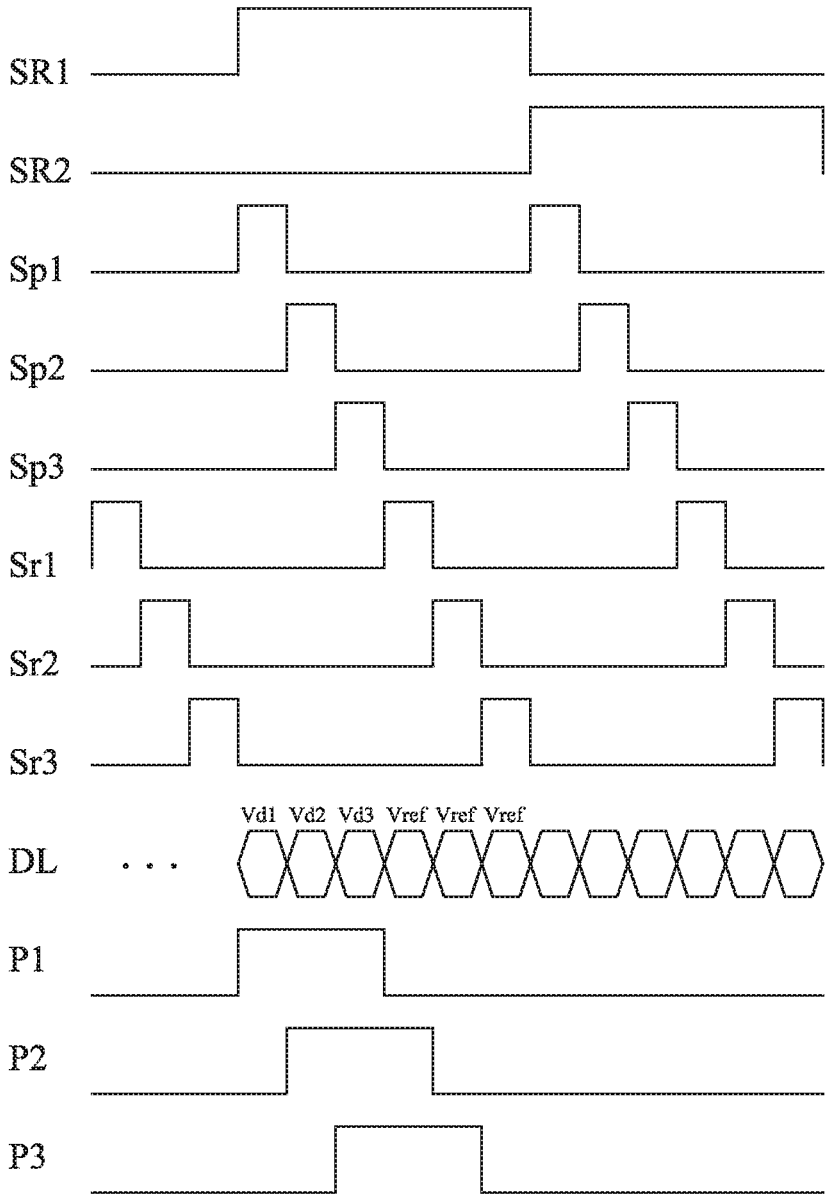
FIG. 3 is a waveform diagram of a control circuit in some embodiments of the present disclosure.

As shown in FIG. 3. FIG. 3 is a waveform diagram of a control circuit in some embodiments of the present disclosure. The scan signals SR1, SR2 are scan voltages sent by the different scan lines GL (only one scan line GL is shown in FIG. 2 for corresponding to a column of pixels).

The first driving circuit 210 drives the first pixel circuit 110 so that the first pixel circuit 110 emits light within the first period P1. The length of time of the first period P1 corresponds to the length of time of the first power supply signal Sp1 to the first reset signal Sr1. Similarly, the control circuit 200 can also include a second driving circuit 220 and a third driving circuit 230. The second driving circuit 220 drives the second pixel circuit 120 so that the second pixel circuit 120 emits light in the second period P2. The length of the second period P2 corresponds to the length of time of the second power supply signal Sp2 to the second reset signal Sr2. The third driving circuit 230 drives the third pixel circuit 130 so that the third pixel circuit 130 emits light within the third period P3. The length of the third period P3 corresponds to the length of time of the third power supply signal Sp3 to the third reset signal Sr3. The operation of multiple drive circuits will be described in detail later.

As mentioned above, the first driving circuit 211 first charges the first pixel circuit 110 to the first data voltage Vd1 according to the first power supply signal Sp1, so the first pixel circuit 110 produces the corresponding light. Then, according to the first reset signal Sr1, the first pixel circuit 110 is reset to the reset voltage Vref. Accordingly, the intensity of the light generated by the first pixel circuit can be accurately changed by "the intensity of the first data voltage Vd1" and "the interval time between the first power supply signal Sp1 and the first reset signal Sr1". In some embodiments, the first power supply signal Sp1 and the first reset signal Sr1 respectively include a pulse signal. Therefore, the control circuit 200 uses a control principle similar to a PWM signal to achieve accurately control of illumination with voltage strength and interval time.

Referring to FIGS. 2 and 3, here explaining an embodiment that the control circuit 200 is implemented as a multiplex circuit. In some embodiments, the control circuit 200 includes the first driving circuit 210, the second driving circuit 220, and the third driving circuit 230. The first driving circuit 210, the second driving circuit 220, and the third driving circuit 230 respectively correspond to the scan line SR1 and multiple sub-pixels of the same pixel in the pixel circuit 100 (i.e., the first pixel circuit 110, the second pixel circuit 120 and the third pixel circuit 130) for respectively controlling the illumination of different colors (e.g., red, green, blue).

The structure of the first driving circuit 210 is as shown in the foregoing embodiment, and will not be further described herein. The circuits of the second driving circuit 220 and the third driving circuit 230 are similar to the first driving circuit 210. The second driving circuit 220 includes a second power supply switch unit 221 and a second reset switch unit 222. The second power supply switch unit 221 is electrically connected to the data line DL and the second pixel circuit 120, and is turned on according to the second power supply signal Sp2. The second reset switch unit 222 is electrically connected to the second pixel circuit 120, and is turned on according to the second reset signal Sr2. Similarly, the third driving circuit 230 includes the third power supply switch unit 231 and the third reset switch unit 232. The third power supply switch unit 231 is electrically connected to the data line DL and the third pixel circuit 130, and is turned on according to the third power supply signal Sp3. The third reset switch unit 232 is electrically connected to the third pixel circuit 130, and is turned on according to the third reset signal Sr3.

In some embodiments, the first power supply signal Sp1, the second power supply signal Sp2, the third power supply signal Sp3, the first reset signal Sr1, the second reset signal Sr2, and the third reset signal Sr3 are sequentially generated by a controller 240 in the display device. In some embodiments, the first power supply signal Sp1, the second power supply signal Sp2, the third reset signal Sr1, the second reset signal Sr1, and the third reset signal Sr3 are alternate with each other without overlapping. In some embodiments, the controller 240 sequentially generates the first power supply signal Sp1, the second power supply signal Sp2, the third power supply signal Sp3, the first reset signal Sr1, the second reset signal Sr2 and the third reset signal Sr3 by the internal multiplexer, and is electrically connected to the control circuit 200 through multiple transmission terminals MUX1 to MUX6 to transmits the foregoing signals.

As shown in FIG. 2, the details of the operation of the control circuit 200 are described herein. In some embodiments, the power supply switch units 211, 221, and 231 respectively include power supply switches Tp1, Tp2, Tp3 and the reset switches Tr1, Tr2, and Tr3. First, the controller 240 transmits a first power supply signal Sp1 to the control terminal of the power supply switch Tp1 in the first power supply switch unit 211 to turn on the power supply switch Tp1. At this time, the data line DL has the first data voltage Vd1, and the first driving circuit 210 charges the first pixel circuit 110 according to the first data voltage Vd1 to generate a corresponding light color (e.g., red).

Then, the controller transmits the second power supply signal Sp2 to the control terminal of the power switch Tp2 of the second power supply switch unit 221 to turn on the power switch Tp2. At this time, the data line DL has the second data voltage Vd2, and the second driving circuit 220 charges the second pixel circuit 120 according to the second data voltage Vd2 to generate a corresponding light color (e.g., green).

Similarly, the controller transmits the third power supply signal Sp3 to the control terminal of the power supply switch Tp3 of the third power supply switch unit 231 to turn on the power supply switch Tp3. At this time, the data line DL has the third data voltage Vd3, and the third driving circuit 230 charges the third pixel circuit 130 according to the third data voltage Vd3 to generate a corresponding light color (e.g., blue).

After the first pixel circuit 110, the second pixel circuit 120, and the third pixel circuit 130 are sequentially charged to generate light, the controller 240 transmits the first reset signal Sr1 to the control terminal of the reset switch Tr1 of the first reset switch unit 212 so as to turn on the reset switch Tr1. At this time, the voltage on the data line DL is the reset voltage Vref, so that the first driving circuit 210 may reset the voltage of the first pixel circuit 110 to the reset voltage Vref.

Next, the controller 240 transmits the second reset signal Sr2 to the control terminal of the reset switch Tr2 of the second reset switch unit 222 to turn on the reset switch Tr2. At this time, the voltage on the data line DL is the reset voltage Vref so that the second driving circuit 220 may reset the voltage of the second pixel circuit 120 to the reset voltage Vref.

Similarly, the controller 240 transmits the third reset signal Sr3 to the control terminal of the reset switch Tr3 in the third reset switch unit 232 to turn on the reset switch Tr3. At this time, the voltage on the data line DL is the reset voltage Vref, so that the third driving circuit 230 may reset the voltage of the third pixel circuit 130 to the reset voltage Vref.

In the foregoing embodiment, the first reset switch unit 212, the second reset switch unit 222, and the third reset switch unit 232 are respectively electrically connected to different transmission terminals MUX4 to MUX6 of the controller 240 so as to sequentially turn on by the controller 240. In other embodiments, the conduction sequence between the first reset switch unit 212, the second reset switch unit 222, and the third reset switch unit 232 can be adjusted. The following is exemplified by different embodiments.

Embodiment A: the power supply switch units 211, 221, and 231 receive the first power supply signal Sp1, the second power supply signal Sp2, and the third power supply signal Sp3, respectively. The control terminal of the first reset switch unit 212 is electrically connected to the transmission terminal MUX4 to receive the first reset signal Sr1. The control end of the second reset switch unit 222 is electrically connected to the transmission terminal MUX 5 to receive the second reset signal Sr2. The control end of the third reset switch unit 232 is electrically connected to the transmission terminal MUX6 to receive the third reset signal Sr3. If the length of a pulse signal in FIG. 3 is P, the illumination times of the pixel circuits 110-130 are all 3P.

Embodiment B: the power supply switch units 211, 221, and 231 receive the first power supply signal Sp1, the second power supply signal Sp2 and the third power supply signal Sp3, respectively. The control terminals of the reset switch units 212, 222, and 232 are electrically connected to the transmission terminal MUX 6 to receive the third reset signal Sr3. If the time length of a pulse signal in FIG. 3 is P, the illumination times of the first pixel circuit 110, the second pixel circuit 120, and the third pixel circuit 130 are 5P, 4P, and 3P, respectively.

Embodiment C: the power supply switch units 211, 221, and 231 receive the first power supply signal Sp1, the second power supply signal Sp2 and the third power supply signal Sp3, respectively. The control terminals of the reset switch units 212, 222 and 232 are electrically connected to the transmission terminal MUX 5 to receive the second reset signal Sr2.

Embodiment D: the power supply switch units 211, 221, and 231 receive the first power supply signal Sp1, the second power supply signal Sp2 and the third power supply signal Sp3, respectively. The control terminals of the reset switch units 212, 222, and 232 are electrically connected to the transmission terminal MUX 4 to receive the first reset signal Sr4. If the time length of a pulse signal in FIG. 3 is P, the illumination times of the first pixel circuit 110, the second pixel circuit 120 and the third pixel circuit 130 are 3P, 2P, and 1P, respectively.

Embodiment E: the power supply switch units 211, 221, and 231 receive the first power supply signal Sp1, the second power supply signal Sp2 and the third power supply signal Sp3, respectively. The control terminal of the first reset switch unit 212 is electrically connected to the transmission terminal MUX6 to receive the third reset signal Sr3. The control terminal of the second reset switch unit 222 is electrically connected to the transmission terminal MUX6 to receive the third reset signal Sr3. The control terminal of the third reset switch unit 232 is electrically connected to the transmission terminal MUX4 to receive the first reset signal Sr1. If the length of a pulse signal in FIG. 3 is P, the illumination times of the first pixel circuit 110, the second pixel circuit 120 and the third pixel circuit 130 are 5P, 4P, and 1P, respectively.

In other words, to increase the "red" light intensity (corresponding to the first pixel circuit 110), the control terminal of the reset switch Tr1 can be changed from is electrically connected to the transmission terminal MUX4 to is electrically connected to the transmission terminal MUX6 so as to be turned on according to the third reset signal Sr3. That is, the charging sequence in the pixel circuit 100 is "the first pixel circuit 110, the second pixel circuit 120, the third pixel circuit 130", and the resetting sequence in the pixel circuit 100 is "the third pixel circuit 130, the second pixel circuit 120, the first pixel circuit 110". Since the first pixel circuit 110 has a longer charging time from charging to resetting, the resulting light will also be brighter.

Figure 4:
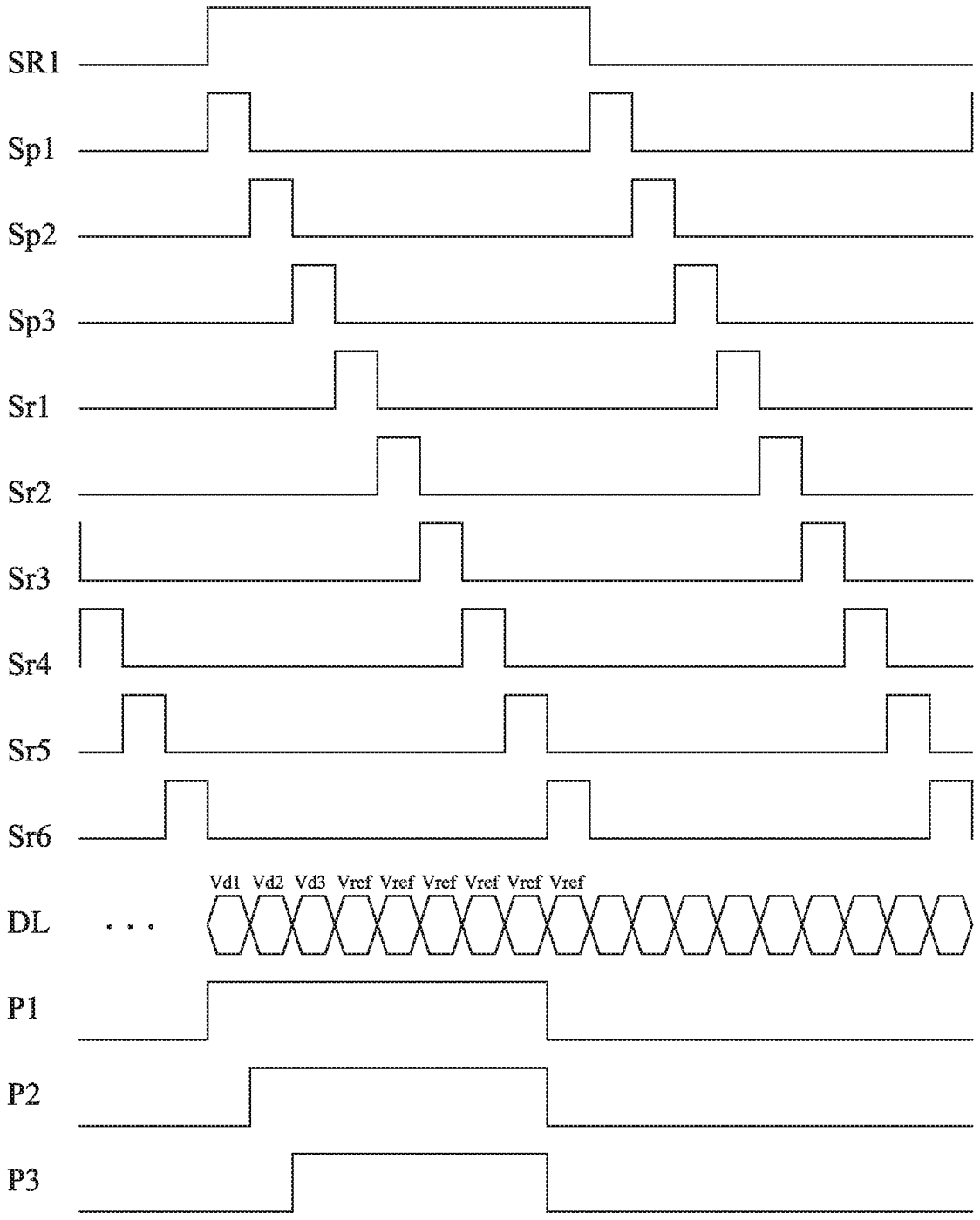
FIG. 4 is a waveform diagram of a control circuit in some embodiments of the present disclosure.

Referring to FIG. 4, FIG. 4 is a signal waveform diagram of the control circuit 200 in some embodiments of the present disclosure. In some embodiments, the controller 240 has a greater number of the transmission terminals MUX1 to MUX9, and can generate a greater number of signals in sequence. As the first reset signal Sr1, the second reset signal Sr2, the third reset signal Sr3, the fourth the reset signal Sr4, the fifth the reset signal Sr5 and the sixth the reset signal Sr6 shown in FIG. 4. Therefore, based on different lighting requirements, the first reset switch unit 212, the second reset switch unit 222 and the third reset switch unit 232 are respectively electrically connected to different transmission terminals MUX4 to MUX9 of the controller 240 to achieve more different brightness combinations.

In addition, in some embodiments, the first power supply switch unit 211, the second power supply switch unit 221 and the third power supply switch unit 231 are turned on at different times according to different power supply signals Sp1 to Sp3, but the first reset switch unit 212, the second reset switch unit 222 and the third reset switch unit 232 can be turned on according to the same reset signal (e.g., all connected to the transmission terminal MUX4 to receive the first reset signal Sr1) so as to reset at the same time.

Figure 5:
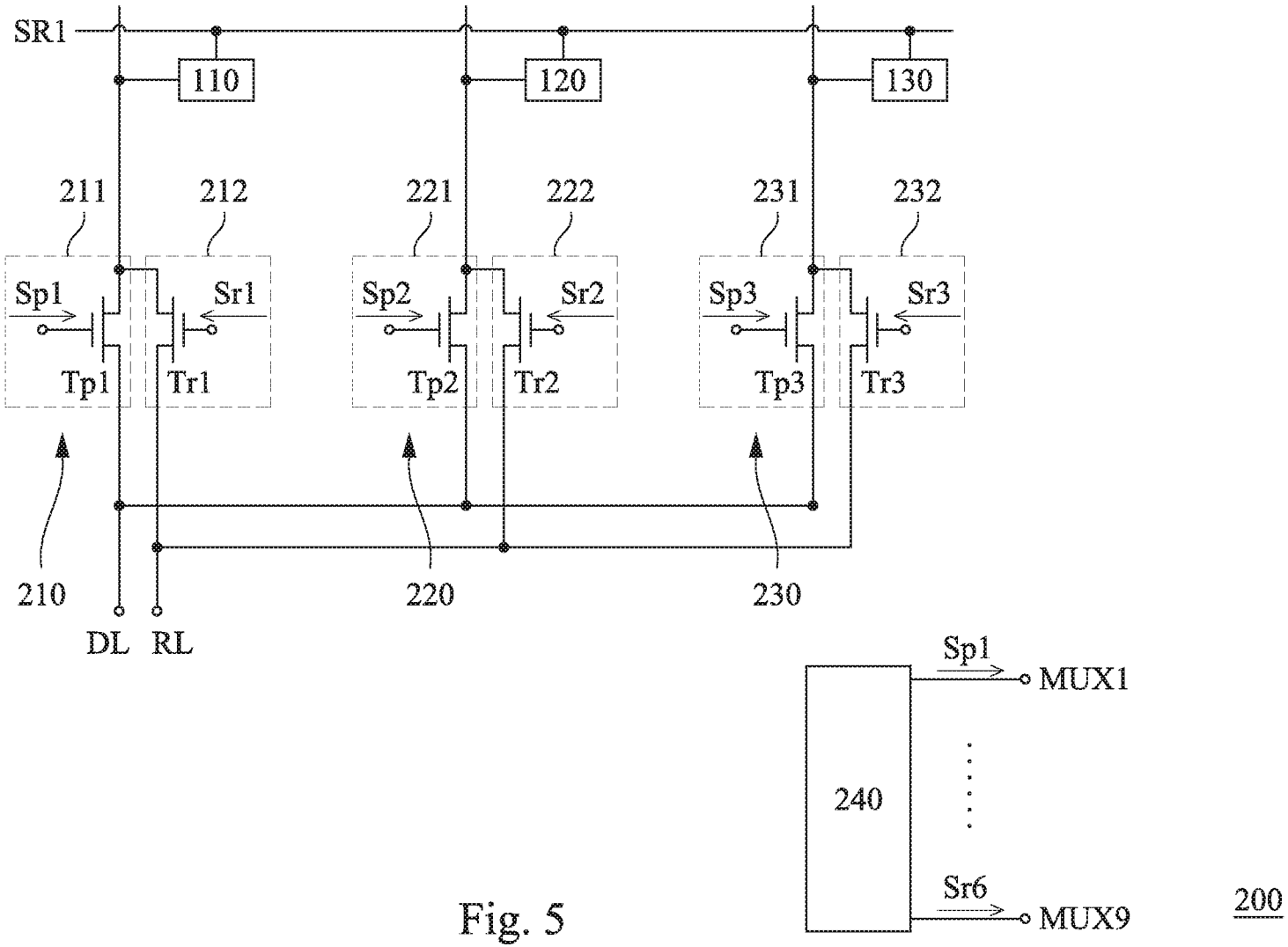
FIG. 5 is a schematic diagram of a control circuit in some embodiments of the present disclosure.

In the foregoing embodiment, the first power supply switch unit 211 is in parallel with the first reset switch unit 212. The second power supply switch unit 221 is connected in parallel with the second reset switch unit 222. The third power supply switch unit 231 is connected in parallel with the third reset switch unit 232. Therefore, the reset switch units 212, 222, and 232 are electrically connected to the data line DL, respectively, to receive the reset voltage Vref. FIG. 5 is a schematic diagram of a control circuit in some embodiments of the present disclosure. In FIG. 5, the similar components associated with the embodiment of FIG. 2 are labeled with the same number for ease of understanding. The specific principle of the similar component has been explained in detail in the previous paragraphs, and unless it has a cooperative relationship with the components of FIG. 5, it is not repeated here. One terminal of the first reset switch unit 212, the second reset switch unit 222 and the third reset switch unit 232 are electrically connected to the first pixel circuit 110, the second pixel circuit 120 and the third pixel circuit 130. The other terminal of the first reset switch unit 212, the second reset switch unit 222 and the third reset switch unit 232 are electrically connected to the reference line RL to receive the reset voltage Vref. Similarly, in FIG. 5, the controller 240 can have a greater number of the transmission terminals MUX1-MUX9 for sequentially generating a greater number of signals to match more different combinations of brightness.

Figure 6:
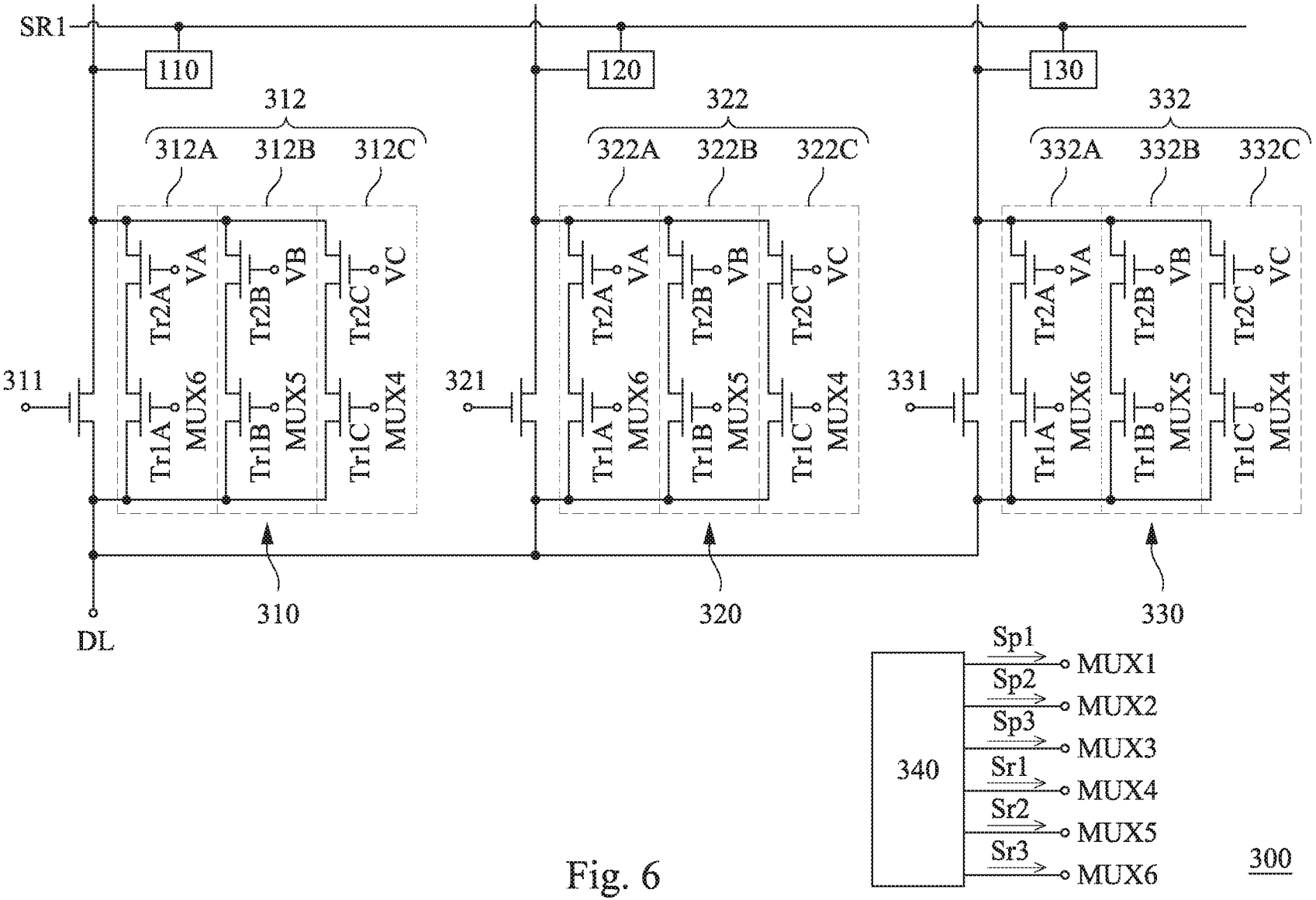
FIG. 6 is a schematic diagram of a control circuit in some embodiments of the present disclosure.

FIG. 6 is a schematic diagram of a control circuit in some embodiments of the present disclosure. In FIG. 6, the similar components associated with the embodiment of FIG. 2 are labeled with the same number for ease of understanding. The specific principle of the similar component has been explained in detail in the previous paragraphs, and unless it has a cooperative relationship with the components of FIG. 6, it is not repeated here.

As mentioned above, in some embodiments, the control circuit 300 includes the first driving circuit 310, the second driving circuit 320 and the third driving circuit 330, and respectively electrically connected to the first pixel circuit 110, the second pixel circuit 120 and the third pixel circuit 130. The first driving circuit 310 includes the first power supply switch unit 311 and the first reset switch unit 312. The second driving circuit 320 includes the second power supply switch unit 321 and the second reset switch unit 322. The third driving circuit 330 includes the third power supply switch unit 331 and the third reset switch unit 332. The circuit structure of the first power supply switch unit 311, the second power supply switch unit 321 and the third power supply switch unit 331 is the same as that of the foregoing embodiment, and therefore will not be repeated here.

In this embodiment, the reset switch units 312, 322, and 332 respectively include at least one or more of the reset circuits 312A to 312C, 322A to 322C, and 332A to 332C. The reset circuits 312A-312C, 322A-322C, 332A-332C are connected in parallel with the corresponding power supply switch units 311-331. Here to take one of the reset circuit 312A as an example. The reset circuit 312A includes the first reset switch Tr1A and the second reset switch Tr2A. The first reset switch Tr1A and the second reset switch Tr2A are connected in series. The first reset switch Tr1A is electrically connected to one of the transmission terminal MUX6 of the controller terminals 340 to receive the reset signal Sr3A, and be turned on accordingly. The second reset switch Tr2A is turned on according to the voltage control signal VA. When the first reset switch Tr1A and the second reset switch Tr2A are simultaneously turned on, the reset circuit 312A is turned on to the first pixel circuit 110, and the voltage of the first pixel circuit 110 is reset to the reset voltage Vref. Similarly, the reset circuit 312B, 312C can be turned on according to the reset signal Sr1B, Sr1C and the voltage control signal VB, VC. Accordingly, by adjusting the voltage of the voltage control signal VA, VB and VC, and adjusting the connection position of the reset circuit 312A-312C and the transmission terminal MUX, the time from the charging to the reset of the first pixel circuit 110 can be changed, and the first pixel circuit 110 can be individually controlled to a variety of different light intensity states.

In some embodiments, the first reset switches Tr1A to Tr1C of the different reset circuits 312A to 312C are respectively electrically connected to different the transmission terminals MUX4 to MUX6, so as to receive different the reset signals Sr1~Sr3. The reset signal Sr1~Sr3 can be combined with different voltage control signals VA~VC to combine a variety of different turn-on times.

Similarly, the reset switch unit 322 includes multiple reset circuits 322A to 322C, and each of the reset circuits 322A to 322C similarly includes the first reset switches Tr1A to Tr1C and the second reset switches Tr2A to Tr2C. Since the operation of the first reset switch Tr1A to Tr1C and the second reset switch Tr2A to Tr2C is the same as that of the reset circuit 312A, it will not be described here.

Figure 7:
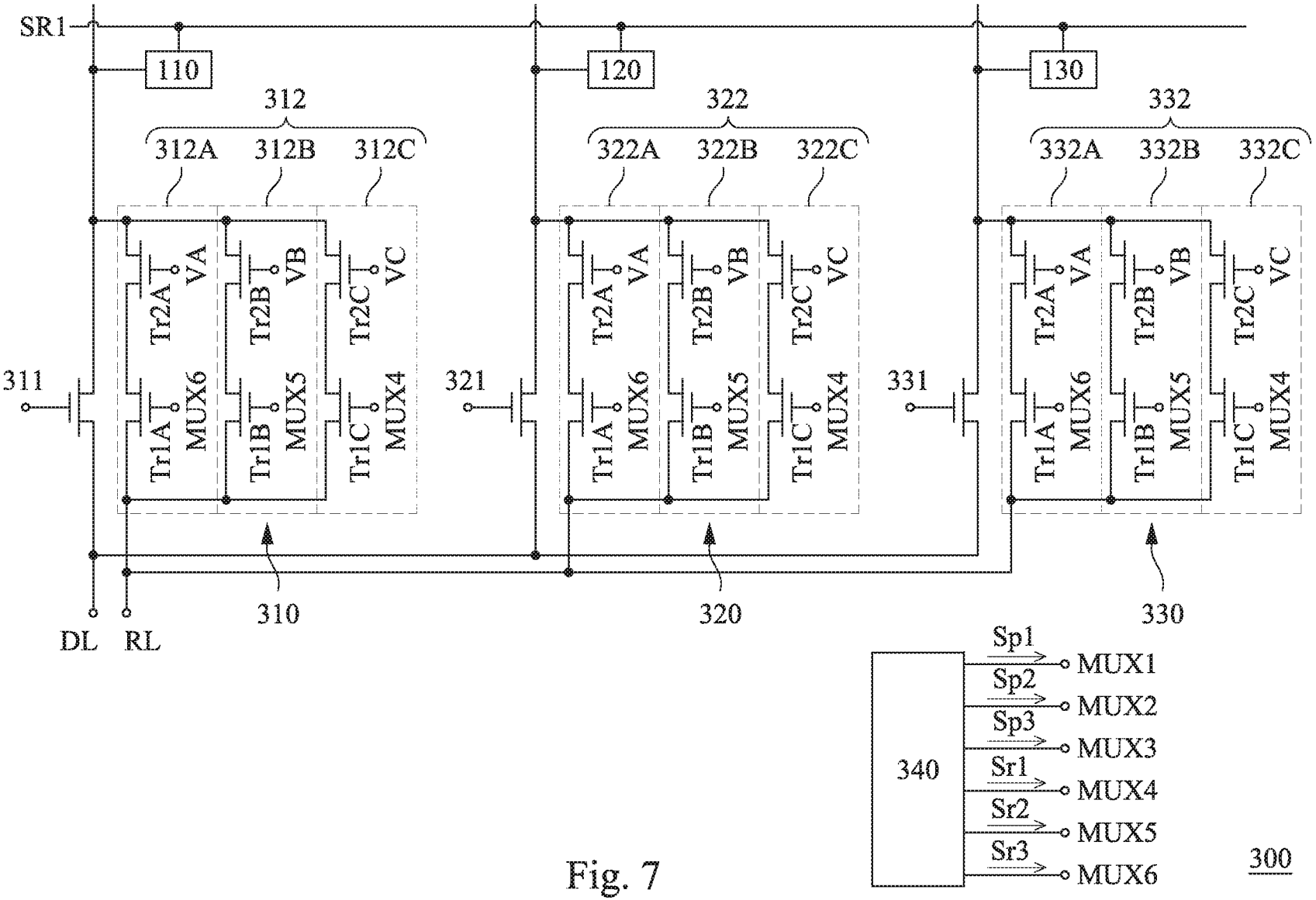
FIG. 7 is a schematic diagram of a control circuit in some embodiments of the present disclosure.

FIG. 7 is a schematic diagram of a control circuit in some embodiments of the present disclosure. In FIG. 7, the similar components associated with the embodiment of FIG. 6 are labeled with the same number for ease of understanding. The specific principle of the similar component has been explained in detail in the previous paragraphs, and unless it has a cooperative relationship with the components of FIG. 7, it is not repeated here.

In this embodiment, one terminal of each of the reset circuits 312A to 312C, 322A to 322C and 332A to 332C are electrically connected to the corresponding pixel circuits 110 to 130. The other terminal of the reset circuits 312A-312C, 322A-322C, 332A-332C is electrically connected to the reference line RL to receive the reset voltage Vref. Accordingly, the control circuit 200 can uniformly receive the reset voltage Vref from the reference line RL without applying the reset voltage Vref to the data line DL.

The components, method steps or technical features in the foregoing embodiments may be combined with each other, and are not limited by the description order or the drawing order in the present disclosure.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A control circuit, comprising:

a first driving circuit comprising a first power supply switch unit and a first reset switch unit, wherein the first driving circuit is electrically connected to a data line and a first pixel circuit, and is configured to turn on according to a first power supply signal; the first reset switch unit is electrically connected to the first pixel circuit, and is configured to turn on according to a first reset signal; and a second driving circuit comprising a second power supply switch unit and a second reset switch unit, wherein the second driving circuit is electrically connected to the data line and a second pixel circuit, and is configured to turn on according to a second power supply signal; the second reset switch unit is electrically connected to the second pixel circuit, and is configured to turn on according to a second reset signal;

wherein the first reset switch unit comprises at least one reset circuit, the at least one reset circuit comprises:

a first reset switch configured to turn on according to the first reset signal; and a second reset switch cascade connected to the first reset switch, and configured to turn on according to a voltage control signal.

2. The control circuit of claim 1, wherein the first power supply switch unit is connected in parallel with the first reset switch unit, and the second power supply switch unit is connected in parallel with the second reset switch unit.

3. The control circuit of claim 1, wherein the first reset switch unit and the second reset switch unit are electrically connected to a reference line to receive a reset voltage.

4. The control circuit of claim 3, wherein when the first power supply switch unit is turned on according to the first power supply signal, the first driving circuit is configured to charge the first pixel circuit according to a first data voltage on the data line; when the first reset switch unit is turned on according to the first reset signal, the first driving circuit is configured to reset a voltage of the first pixel circuit to the reset voltage.

5. The control circuit of claim 4, wherein the first power supply signal and the first reset signal respectively comprise a pulse signal.

6. The control circuit of claim 1, wherein the first power supply signal, the first reset signal, the second power supply signal and the second reset signal are sequentially generated by a controller.

7. A control circuit, comprising:

a power supply switch unit electrically connected to a data line and a pixel circuit, wherein when the data line has a data voltage, the power supply switch unit is turned on according to a power supply signal so that the pixel circuit is charged by the data voltage; and a reset switch unit electrically connected to the pixel circuit, wherein after the pixel circuit is charged by the data voltage, the reset switch unit is turned on according to a reset signal to reset a voltage of the pixel circuit to a reset voltage;

wherein the reset switch unit comprises at least one reset circuit, the at least one reset circuit comprises:

a first reset switch configured to turn on according to the reset signal; and a second reset switch cascade connected to the first reset switch, and configured to turn on according to a voltage control signal.

8. The control circuit of claim 7, wherein the power supply switch unit is connected in parallel with the reset switch unit so that the reset switch unit is electrically connected to the data line to receive the reset voltage.

9. The control circuit of claim 7, wherein the reset switch unit is electrically connected to a reference line to receive the reset voltage.

10. The control circuit of claim 7, wherein the power supply signal and the reset signal are sequentially generated by a controller.

11. The control circuit of claim 7, wherein the power supply signal and the reset signal respectively comprise a pulse signal.

* * * * *